US006614145B2

(12) United States Patent
Fleetwood et al.

(10) Patent No.: US 6,614,145 B2
(45) Date of Patent: Sep. 2, 2003

(54) TWO-PIECE SWAGED CENTER ELECTRODE ASSEMBLY

(75) Inventors: Charles T. Fleetwood, Easley, SC (US); Ned A. Schmaltz, Travelers Rest, SC (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/934,068

(22) Filed: Aug. 21, 2001

(65) Prior Publication Data

US 2003/0038574 A1 Feb. 27, 2003

(51) Int. Cl.[7] ..... H01T 13/20; H01T 13/22

(52) U.S. Cl. ..... 313/141; 313/144; 313/135; 445/7

(58) Field of Search ..... 313/141, 144, 313/142, 128, 118, 135, 136; 445/7; 123/169 EL, 169 R; 228/128, 173.5

(56) References Cited

U.S. PATENT DOCUMENTS

| | | | | |
|---|---|---|---|---|
| 1,344,954 A | | 6/1920 | Meyer | |
| 1,633,435 A | | 6/1927 | Alcocer et al. | |
| 1,968,314 A | | 7/1934 | Rohde | 29/155.51 |
| 3,548,472 A | | 12/1970 | Urushiwara et al. | 29/25.12 |
| 3,569,765 A | * | 3/1971 | Moray | 313/135 |
| 3,857,145 A | | 12/1974 | Yamaguchi et al. | 29/25.12 |
| 3,868,530 A | | 2/1975 | Eaton et al. | |
| 3,984,717 A | | 10/1976 | Romanowski et al. | 313/141 |
| 4,526,551 A | | 7/1985 | Hoffmanner et al. | 445/7 |
| 4,684,352 A | | 8/1987 | Clark et al. | 445/7 |
| 4,695,759 A | | 9/1987 | Podiak | 313/136 |
| 4,771,210 A | | 9/1988 | Mohle et al. | |
| 5,101,135 A | | 3/1992 | Oshima | 313/142 |
| 5,510,667 A | | 4/1996 | Loffler et al. | |
| 5,557,158 A | | 9/1996 | Kanao et al. | 313/141 |
| 5,869,921 A | | 2/1999 | Matsutani et al. | 313/141 |
| 5,998,913 A | | 12/1999 | Matsutani | 313/141 |
| 6,069,434 A | | 5/2000 | Clifford | 313/141 |
| 6,078,129 A | | 6/2000 | Gotou et al. | 313/141 |
| 6,094,000 A | | 7/2000 | Osamura et al. | 313/141 |

* cited by examiner

*Primary Examiner*—Nimeshkumar D. Patel
*Assistant Examiner*—Karabi Guharay
(74) *Attorney, Agent, or Firm*—Reising, Ethington, Barnes, Kisselle, P.C

(57) ABSTRACT

An igniter having a two-piece center electrode assembly that includes an upper electrode member and an iridium lower electrode member. The two electrode members are assembled together by insertion of an expanded head section of the iridium electrode into a blind hole within the upper electrode. The upper electrode is then swaged over the expanded head section to provide a positive mechanical interlock of the two electrode members together. Thereafter, the two components are brazed together by heating of a brazing compound that is pre-loaded into the blind hole prior to insertion of the expanded head section. This assembly results in both a mechanical and metallurgical bond between the two components without subjecting the iridium electrode to deformation that could otherwise result in axial cracking of the iridium material.

20 Claims, 1 Drawing Sheet

TWO-PIECE SWAGED CENTER ELECTRODE ASSEMBLY

FIELD OF THE INVENTION

The present invention relates generally to center electrode assemblies for spark plugs and igniters and, more particularly, to multi-piece center electrode assemblies that utilize an iridium-based firing tip.

BACKGROUND OF THE INVENTION

Over the years, a variety of erosion resistant metals and alloys have been employed in center electrode assemblies to increase the life of igniters and spark plugs used in turbine and piston engines. Metals such as platinum and iridium have proven to exhibit improved consumption resistance and ignitability. Because of their expense, these noble metals are not typically used for the entire center electrode, but rather are used only to form a firing tip at the working end of the center electrode where the spark is produced. In this way, erosion at the firing surfaces can be reduced without the expense of forming the entire center electrode from the more expensive metal. Apart from their cost, most of these metals have other inherent drawbacks that complicate their use as a firing tip. For instance, platinum has a relatively low melting point (1769° C.) and while iridium has a much higher melting temperature (2454° C.), it has poor weld characteristics and is a brittle metal that exhibits axial cracking when subjected to deformation or significant pressure.

An example of the use of iridium in conjunction with a spark plug center electrode can be seen in U.S. Pat. No. 5,557,158 issued to Kanao et al. The Kanao patent discloses a spark plug center electrode having a cylindrical or ringlike iridium insert mechanically attached to the end of the electrode. The iridium insert is attached to the electrode by welding or by otherwise securing a stopper component to the very tip of the center electrode, thereby securing the iridium insert between the two components and preventing it from being dislodged.

The poor weld characteristics of iridium make it difficult to metallurgically attach iridium firing tips to other electrode components. Similarly, iridium has not be considered a good candidate for swaging or otherwise mechanically attaching it to the center wire because of the potential for cracking. However, where more traditional (non-iridium) metals have been used, various approaches have been proposed for mechanically connecting center electrode components together. For example, U.S. Pat. No. 1,344,954 to Meyer discloses a two-piece spark plug center electrode assembly wherein a lower electrode member having an expanded head section is received by inwardly biased retaining jaws of an upper electrode member. The axial location at which the retaining jaws contact the expanded head section is variable depending on the axial position of the upper member, which may be adjusted via threads located at its upper end. Thus, the two electrode members are mechanically secured to each other through the radially-inward pressure imparted by the retaining jaws against the expanded head section.

Similarly, U.S. Pat. No. 1,633,435 to De Alcocer et al. discloses a two-piece spark plug center electrode assembly in which the stem of a lower electrode member is inserted into a receiving element of an upper electrode member. The upper member is threaded at one axial end and terminates into a hollow conical head section for receiving the stem of the lower member at the other axial end. Downward axial movement of the upper member against the lower member, by the tightening of a nut over the threaded portion of the upper member, causes the conical head section to contract over the lower member stem, thereby securing the two members together.

U.S. Pat. No. 6,069,434 to Clifford discloses a three-piece spark plug center electrode assembly wherein input and emitter electrodes are coupled together via an interconnector. The interconnector is a hollow cylindrical body having a series of indentations located on its surface for gripping the input and emitter electrodes. In assembly, the input and emitter electrodes are inserted into opposite ends of the interconnector, and the interconnector is crimped around the electrodes such that the indentations grasp and retain the input and emitter in place. Because the input and emitter members do not physically contact each other, the interconnector serves as both a mechanical and electrical connector.

None of these latter patents are directed to the problems associated with use of a multi-piece center electrode that uses an iridium electrode member at the firing end of the center electrode assembly. There is thus a need for a center electrode assembly that provides a connection between the iridium and other electrode component that is both secure from separation and that does not damage the structural integrity of the iridium during the attachment process.

SUMMARY OF THE INVENTION

The above-noted shortcomings of prior art center electrode assemblies are overcome by the present invention which provides a center electrode assembly for use in an ignition device such as a spark plug or igniter. The center electrode assembly includes elongated first and second electrode members. The first electrode member has first and second axial ends with a hole extending into the second axial end. The second electrode member comprises iridium and has third and fourth axial ends and a head section located at the third axial end. The head section is positioned within the hole of the first electrode member such that the second axial end of the first electrode member is swaged over the head section, thereby mechanically securing the first electrode member to the second electrode member. Preferably, the head section comprises a radially expanded head that is not only connected to the first electrode member by swaging of the second axial end over the head section, but also by brazing of the head section to the first electrode member within the hole. The center electrode assembly constructed in this manner can be incorporated into an ignition device that also includes a shell having an axial bore, a ground electrode connected at a lower axial end of the shell, and an insulator secured within the shell's axial bore. The center electrode assembly is located within a central bore of the insulator at its lower axial end.

In accordance with another aspect of the invention, there is provided a method for producing a multi-piece center electrode assembly for use in an ignition device. The method comprises the steps of:

(a) providing an elongated first electrode member having a hole located at an axial end, (b) providing an elongated second electrode member having a radially expanded head section located at an axial end, (c) introducing brazing compound into the blind hole, (d) inserting the head section into the blind hole, (e) swaging the axial end of the first electrode member around the head section, and (f) heating the brazing compound to a temperature sufficient to braze the first and second electrode members together.

Preferably, the second electrode member comprises iridium so that, by swaging the non-iridium electrode member over the iridium electrode member and then heating the assembled components to brazing temperatures, the electrodes are both mechanically and metallurgically connected together in a manner that helps maintain the integrity of the braze joint over time while not causing any significant axial cracking of the iridium that could otherwise occur if it were to be deformed.

Objects, features, and advantages of the invention include providing an iridium tipped multi-piece electrode assembly for an ignition device that allows for the two electrode members to be securely fastened together without compromising the structural and electrical integrity of the lower iridium member. Additionally, the invention enables the center electrode assembly to be designed in a manner that is economical to manufacture and assemble and that can provide a relatively long and useful life in service.

DESCRIPTION OF THE DRAWINGS

A preferred exemplary embodiment of the invention will hereinafter be described in conjunction with the appended drawings, wherein like designations denote like elements, and wherein.

DETAILED DESCRIPTION OF THE PREFERRED EMBODIMENT

Figure 1:
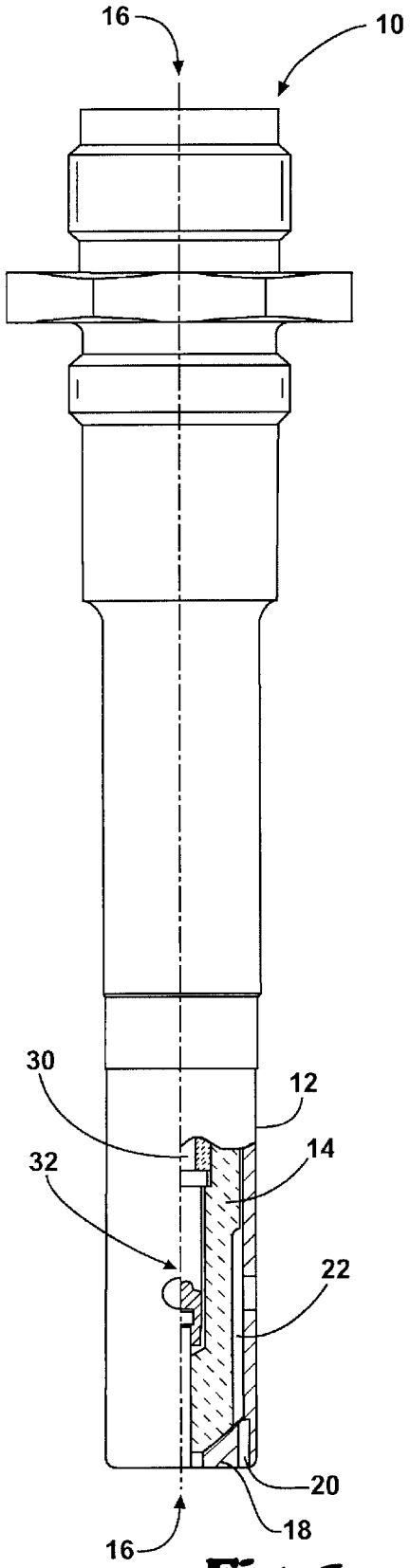
FIG. 1 is a partially cutaway view of an igniter plug constructed according to the present invention.

With reference to FIG. 1, there is shown an igniter plug (or, simply, igniter) 10 for use in a turbine engine of an aircraft. Igniter 10 generally includes a shell 12, insulator 14, center wire assembly 16, and ground electrode 18. As is commonly known in the art, the shell 12 is a generally cylindrical, electrically conductive component having a bore running its entire axial length. Located within the bore of shell 12 is the insulator 14 which also includes its own central bore for receipt of the center wire assembly 16. The center wire assembly 16 includes an upper terminal end electrode 30 as well as a lower center electrode assembly 32, and extends the entire axial length of the spark plug assembly 10. Mechanically and electrically connected to the lower axial end of the shell is ground electrode 18. The lower tips of the center electrode assembly and ground electrode are located at an equivalent axial position, yet they are radially spaced apart such that they form a spark gap. The ground electrode 18 can include a number of spaced vent holes 20 that open into an annular chamber 22 between the shell 12 and insulator 14, as is known. A semiconducting material (not shown) can be included at the firing end between the center and ground electrodes 16, 18 or as a coating on the insulator 14 to provide reduced required sparking voltage for low and medium tension plugs. Such use of a semiconducting material is known to those skilled in the art. The shell 12, insulator 14, ground electrode 18, and terminal end electrode 30 can be constructed in a conventional fashion using materials and techniques that are well known to those skilled in the art.

In operation, the terminal end electrode 30 is provided with a high energy pulse from the ignition system which travels down the center wire assembly 16 until it reaches the lower end of the center electrode assembly. Assuming the pulse has sufficient energy to bridge the spark gap, it then travels to the ground electrode 18 which is grounded or otherwise connected to the ignition system's return path. While the general operation and overall structure of the illustrated igniter is well established within the art, the particular design of the lower center electrode assembly 32 is not.

Figure 2:
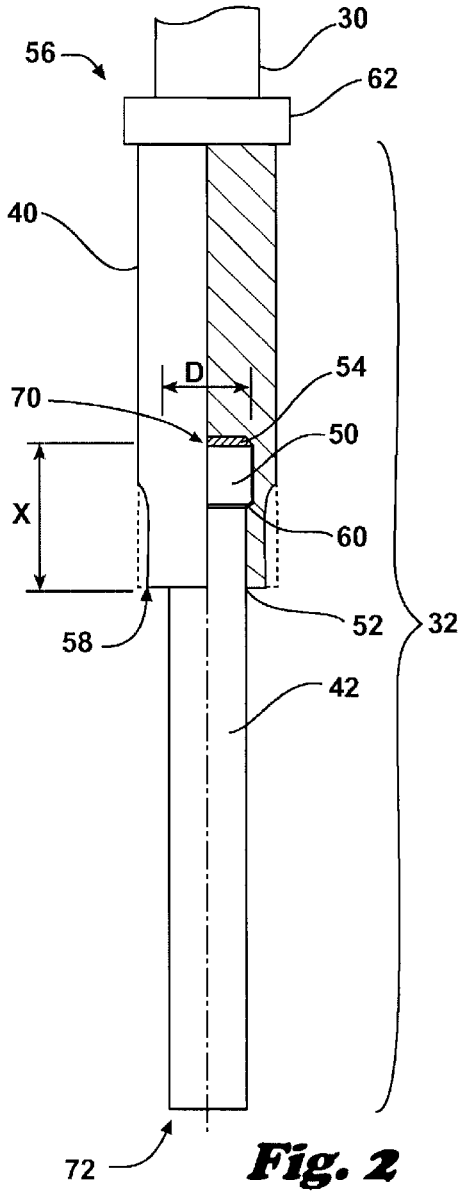
FIG. 2 is an exploded view of the center electrode assembly shown in FIG. 1.

Referring now to FIG. 2, there is shown the two-piece center electrode assembly 32 which is divided into an elongated first electrode member 40, referred to as the intermediate electrode, and an elongated second electrode member 42, referred to as the firing end electrode. This firing end electrode 42 comprises iridium, meaning that it includes at least enough iridium to provide reduced spark erosion to whatever degree is desired or required for a particular application of igniter 10. Thus, the iridium electrode 42 can be pure iridium or in the form of an alloy that contains other constituent elements. In order to securely fasten the intermediate and firing end electrodes together, an expanded head section 50 is located on the uppermost end of the firing end electrode 42 and is inserted into a hole 52 located on the lowermost end of the intermediate electrode 40. Once inserted, the outer circumferential surface of the lower end of the intermediate electrode 40 is swaged, or crimped, around the head section 50 to create a mechanical interlock between the two pieces. Furthermore, a brazing material (usually in a solid or paste form) is inserted into hole 52 along with the head section 50, and following swaging, the components are heated to a temperature sufficient to create a braze joint 54 between the two center electrode components. In this way, the two electrode members are both mechanical and metallurgically connected together.

Figure 3:
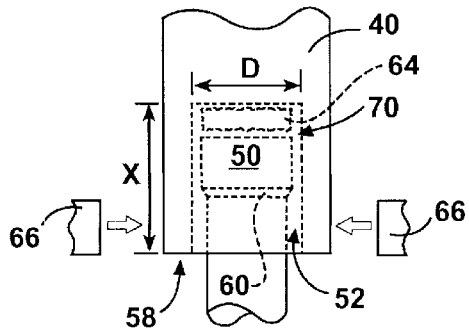
FIG. 3 depicts the method used to form the center electrode assembly of FIG. 2.

The intermediate electrode 40 is an elongated generally cylindrical conductive component that primary includes an upper axial end 56, a lower axial end 58, and hole 52. In the preferred embodiment, the intermediate electrode is an iron/nickel/cobalt alloy (approximately 54% iron, 29% nickel, 17% cobalt) that can be purchased through Carpenter Technologies Corp. under the trade-name Kovar®. The upper axial end includes a flange 62 which is designed to support the terminal electrode 30, which seats on top of it, such that an electrical pulse may flow between the two components. This junction also employs measures for strengthened attachment, such as resistance welding, to further secure the components together. Furthermore, flange 62 engages a circumferential interior shoulder (FIG. 1) of the insulator axial bore. By seating the flange on this shoulder, the intermediate electrode 40, and hence the center electrode assembly 16, is prevented from becoming dislodged and falling into the combustion chamber. In the preferred embodiment, the outer diameter of the intermediate electrode is approximately 0.125" and is substantially uniform throughout its axial length, excluding the expanded flange 62. However, it is envisioned that this diameter could vary along the axis as may be necessary to conform to the interior shape of the axial bore or some other component. As seen more clearly in FIG. 3, hole 52 is a cylindrical blind hole (meaning the hole does completely extend from one axial end to the other) extending a predetermined distance X into lower axial end 58 such that the hole is generally co-axial with the intermediate electrode and is deep enough to sufficiently receive head section 50, as will be subsequently explained. The distance X may vary depending on the various factors such as the dimensions of the head section, but in the preferred embodiment is approximately 0.225".

The inner diameter of the hole D is substantially uniform along the distance X, however, as previously mentioned in reference to the outer diameter of the intermediate electrode, this could vary as a function of axial position. The lower axial end 58 seen in FIG. 3 and in phantom in FIG. 2, illustrates the shape of the lower axial end 58 before the swaging process takes place, after that process, the outer diameter of the lower axial end will be less.

Referring back to FIG. 2, the firing end electrode 42 comprises iridium and is also generally cylindrical and elongated, having an upper axial end 70 and a lower axial end 72. In the preferred embodiment, the firing end electrode comprises approximately 99.9% iridium (remaining constituents being trace elements), and the diameter is approximately 0.061" (excluding the head section). As previously mentioned, head section 50 is located at the upper axial end 70 of the firing electrode. The head section and firing electrode may be formed from a single stock of material by methods commonly known in the art, such as grinding. Located at the opposite axial end of the firing electrode is the lower axial end 72. This component, in conjunction with ground electrode 18, forms a spark gap that, when supplied with sufficient voltage, produces a spark and thus begins the combustion process.

The center electrode assembly of the present invention addresses the known difficulties in attaching iridium firing tips by utilizing a swaged and brazed connection that forms a mechanical interlock and metallurgical bond between the intermediate and firing end electrodes. In assembly, a suitable brazing compound 64, such as a nickel braze compound sold under the trade-name Nicro-braze® 130 (92% nickel, 4.5% silicon, 2.9% boron; AMS Specification #4778), is inserted into hole 52 prior to the insertion of the head section 50. Other braze applications are possible such as feeding the joint from an external feedhole. Once a sufficient quantity of the brazing compound is present within the hole, the upper axial end 70 is inserted under pressure and the brazing compound is dispersed throughout the hole 52. As previously mentioned, the inner hole diameter D and outer diameter of the head section 50 must complement each other such that the hole 52 is large enough to accommodate the head section, yet not so large that the lower axial end 58 is unable to sufficiently grasp the head section once the swaging process takes place. After the intermediate and firing end electrodes are in place along with the brazing compound 64, a swaging tool 66 is brought into place and applies pressure all around the circumferential surface of lower axial end 58. This pressure crimps lower axial end 58 such that the inner surface of hole 52 contacts both an inverted shoulder 60 and the shaft portion of the iridium electrode just below head section 50, thereby preventing the firing end electrode 42 from backing out of the hole 52. After this process has occurred, the outer diameter of the swaged section is approximately 0.100" and the swaged area extends for an axial distance of about 0.154"–0.214". To further strengthen the bond between these two components, the swaged center electrode assembly 32 is then placed in a brazing apparatus, such as an oven, and subjected to heat sufficient to create a braze joint 54 using the brazing compound 64. During the firing process, brazing material 64 wicks all throughout the hole and around the head section thereby providing thorough material coverage. Other methods of activating brazing compound 64 may be known to those skilled in the art, such as induction brazing, heating the firing end electrode, and any of these methods can be used without departing from the scope of the invention. As will be appreciated, this combination of swaging and brazing provides both a mechanical interlock and metallurgical bond to keep the center electrode assembly 32 intact when it is exposed to the severity of the combustion environment.

It will thus be apparent that there has been provided in accordance with the present invention an igniter and center electrode assembly therefor which achieves the aims and advantages specified herein. It will, of course, be understood that the foregoing description is of a preferred exemplary embodiment of the invention and that the invention is not limited to the specific embodiment shown. For instance, the center electrode assembly of the present invention may be employed in other types of ignition devices such as spark plugs used for reciprocating engine. Various changes and modifications will become apparent to those skilled in the art and all such changes and modifications are intended to be within the scope of the present invention.

We claim:

1. A center electrode assembly for use in a spark plug or igniter assembly, comprising:

an elongated first electrode member having first and second axial ends with a hole extending into said second axial end; and an elongated second eletrode member comprising iridium and having third and fourth axial ends and a head section located at said third axial end, wherein said head section is located within said hole with said second axial end being swaged over said head section to thereby mechanically interlock said first and second electrode members, and wherein said second electrode member extends out of said hole with said fourth axial end being located outside of said hole; and wherein said second member has a diameter at said fourth axial end that is less than its diameter at said head section.

2. The center electrode assembly of claim 1, wherein said head section includes an inverted shoulder and said second axial end is swaged over said head section such that portions of said second axial end extend radially inwardly to engage said inverted shoulder, thereby creating a mechanical interlock between said first and second electrode members.

3. The center electrode assembly of claim 2, wherein said swaged second axial end engages said inverted shoulder at a first axial position and said head section has an end located opposite the portion of said head section that includes said inverted shoulder, and wherein distance across said hole at said first axial position is less than a corresponding distance across said head section at an axial position intermediate said first axial position and said end of said head section.

4. The center electrode assembly of claim 2, wherein an outer diameter of said swaged second axial end is less than an outer diameter of said first electrode member at other axial positions.

5. The center electrode assembly of claim 1, wherein said hole extends into said second axial end at an orientation that is generally coaxial with said first electrode member.

6. The center electrode assembly of claim 5, wherein said hole is a blind hole extending a predetermined distance into said second axial end.

7. The center electrode assembly of claim 6, wherein said head section is inserted into said blind hole such that said head section abuts a back surface of said blind hole.

8. The center electrode assembly of claim 1, wherein said head section is a radially expanded head section.

9. A center electrode assembly for use in a spark plug or igniter assembly, comprising:

an elongated first electrode member having first and second axial ends with a hole extending into said second axial end; and an elongated second electrode member comprising iridium and having third and fourth axial ends and a head section located at said third axial end, wherein said head section is located within said hole with said second axial end being swaged over said head section of said second electrode member whereby said first electrode member is mechanically secured to said second electrode member; and wherein said first and second electrode members are metallurgically fused together, thereby creating both mechanical and a metallurgical connection.

10. The center electrode assembly in claim 9, wherein the metallurgical connection comprises a braze joint.

11. A two-piece center electrode assembly for use in a spark plug or igniter assembly, comprising:

an elongated first electrode member having a lower axial end with a blind hole extending into said lower axial end at an orientation that is generally coaxial with said first electrode member, and an elongated second electrode member comprising iridium and having a body section with an upper axial end and a radially expanded head located at said upper axial end, wherein said head section is sized to be inserted into said blind hole such that said lower axial end is swaged around said head section and said first and second electrode members are metallurgically connected, thereby providing both a mechanical and a metallurgical connection.

12. A method of producing a center electrode assembly for use in a spark plug or igniter assembly, the method comprising the steps of:

(a) providing an elongated first electrode member having a blind hole located at an axial end, (b) providing an elongated second electrode member having a radially expanded head section located at an axial end, (c) introducing brazing compound into said blind hole, (d) inserting said head section into said blind hole, (e) swaging said axial end of said first electrode member around said head section, and (f) heating said brazing compound to a temperature sufficient to braze said first and second electrode members together.

13. The method of claim 12, wherein said second electrode member comprises iridium.

14. The method of claim 12, wherein step (f) further comprises heating said first and second electrode members together with said brazing compound to a temperature sufficient to braze said first and second electrode members together.

15. The method of claim 12, wherein step (f) further comprises heating one of said first or second electrode members and bringing said heated electrode member into contact with said brazing compound such that said brazing compound is brought to a temperature sufficient to braze said first and second electrode members together.

16. A spark plug assembly for use in internal combustion engines, comprising:

a spark plug shell having an axial bore and a lower axial end, a ground electrode connected to said lower axial end of said spark plug shell, a spark plug insulator secured within said spark plug shell axial bore and having a separate axial bore that is generally coaxial with said axial bore of said shell, and;

a center electrode assembly secured within said insulator axial bore and comprising:

an elongated first electrode member having first and second axial ends with a hole extending into said second axial end; and an elongated second electrode member comprising iridium and having third and fourth axial ends and a head section extending from said third axial end, wherein said head section is located within said hole with said second axial end being swaged over said head section to thereby mechanically interlock said first and second electrode members, and wherein said second electrode member extends out of said hole with said fourth axial end being located outside of said hole; and wherein said second member has a diameter at said fourth axial end that is less than its diameter at said head section.

17. The spark plug assembly of claim 16, wherein said first and second electrode members are metallurgically fused together, thereby creating both a mechanical and a metallurgical connection.

18. An igniter assembly for use in internal combustion engines, comprising:

an igniter shell having an axial bore and a lower axial end, a ground electrode connected to said lower axial end of said igniter shell, an insulator secured within said igniter shell axial bore and having a separate axial bore that is generally coaxial with said axial bore of said shell, and;

a center electrode assembly secured within said insulator axial bore and comprising:

an elongated first electrode member having first and second axial ends with a hole extending into said second axial end; and an elongated second electrode member comprising iridium and having third and fourth axial ends and a head section extending from said third axial end, wherein said head section is located within said hole with said second axial end being swaged over said head section to thereby mechanically interlock said first and second electrode members, and wherein said second electrode member extends out of said hole with said fourth axial end being located outside of said hole; and wherein said second member has a diameter at said fourth axial end that is less than its diameter at said head section.

19. The igniter assembly of claim 18, wherein said first and second electrode members are metallurgically fused together, thereby creating both a mechanical and a metallurgical connection.

20. The igniter assembly of claim 18, wherein said head section of said second electrode member is brazed to said first electrode member within said hole.

* * * * *

UNITED STATES PATENT AND TRADEMARK OFFICE

CERTIFICATE OF CORRECTION

PATENT NO. : 6,614,145 B2
DATED : September 2, 2003
INVENTOR(S) : Charles T. Fleetwood and Ned A. Schmaltz It is certified that error appears in the above-identified patent and that said Letters Patent is hereby corrected as shown below:

Column 1,
Line 44, after "has not" delete "be" and insert therein -- been --.

Column 4,
Line 36, after "component that" delete "primary" and insert therein -- primarily --.

Column 6,
Line 22, after "second" delete "eletrode" and insert -- electrode --.
Line 44, after "and wherein" insert -- a --.

Signed and Sealed this

Twenty-fourth Day of February, 2004

JON W. DUDAS
*Acting Director of the United States Patent and Trademark Office*